US011168687B2

(12) United States Patent
Hayashi

(10) Patent No.: US 11,168,687 B2
(45) Date of Patent: Nov. 9, 2021

(54) SCROLL COMPRESSOR

(71) Applicant: DENSO CORPORATION, Kariya (JP)

(72) Inventor: Hiroyuki Hayashi, Kariya (JP)

(73) Assignee: DENSO CORPORATION, Kariya (JP)

( * ) Notice: Subject to any disclaimer, the term of this patent is extended or adjusted under 35 U.S.C. 154(b) by 119 days.

(21) Appl. No.: 16/657,589

(22) Filed: Oct. 18, 2019

(65) Prior Publication Data

US 2020/0049145 A1 Feb. 13, 2020

Related U.S. Application Data

(63) Continuation of application No. PCT/JP2018/018202, filed on May 10, 2018.

(30) Foreign Application Priority Data

May 16, 2017 (JP) ..... JP2017-097538

(51) Int. Cl.
*F04C 18/02* (2006.01)
*F04C 29/00* (2006.01)

(52) U.S. Cl.
CPC ..... *F04C 18/0215* (2013.01); *F04C 29/0021* (2013.01); *F04C 2240/102* (2013.01); *F04C 2240/807* (2013.01); *F04C 2270/701* (2013.01)

(58) Field of Classification Search
CPC ..... F04C 18/0215; F04C 2240/102; F04C 2240/807; F04C 2270/701; F04C 27/005; F04C 29/0021
See application file for complete search history.

(56) References Cited

U.S. PATENT DOCUMENTS 6,872,063 B2 * 3/2005 Kimura ..... F04C 27/005 418/55.5

FOREIGN PATENT DOCUMENTS

| | | | | |
|---|---|---|---|---|
| EP | 1 818 541 A1 | | 8/2007 | |
| JP | H03-099887 U | | 10/1991 | |
| JP | H0399887 U | * | 10/1991 | |
| JP | 04031689 A | * | 2/1992 | ..... F04C 28/00 |
| JP | 2003-035286 A | | 2/2003 | |
| JP | 2007-315224 A | | 12/2007 | |

(Continued)

OTHER PUBLICATIONS

Jul. 24, 2018 Search Report issued in International Patent Application No. PCT/JP2018/018202.

*Primary Examiner* — Mark A Laurenzi
*Assistant Examiner* — Xiaoting Hu
(74) *Attorney, Agent, or Firm* — Oliff PLC

(57) ABSTRACT

A back pressure chamber forming portion forms a back pressure chamber configured to accumulate a high pressure refrigerant discharged from a working chamber and thereby generate a refrigerant pressure, which urges a movable scroll against a stationary scroll. A balancer is placed at an inside of the back pressure chamber and is configured to be rotated by a rotatable shaft. The back pressure chamber forming portion has a discharge hole that communicates between a radially outer side of the back pressure chamber, which is located radially outward in a radial direction of an axis of the rotatable shaft, and a suction chamber to discharge a liquid phase refrigerant from the back pressure chamber into the suction chamber when the liquid phase refrigerant flows from the working chamber into the back pressure chamber.

3 Claims, 6 Drawing Sheets

(56) References Cited

FOREIGN PATENT DOCUMENTS

| | | | | | |
|---|---|---|---|---|---|
| JP | 2013-113212 | A | | 6/2013 | |
| JP | 2013-155643 | A | | 8/2013 | |
| JP | 2018025154 | A | * | 2/2018 | ..... F04C 28/00 |

* cited by examiner

RELATED ART

SCROLL COMPRESSOR

CROSS REFERENCE TO RELATED APPLICATIONS

This application is a continuation application of International Patent Application No. PCT/JP2018/018202 filed on May 10, 2018, which designated the U.S. and claims the benefit of priority from Japanese Patent Application No. 2017-97538 filed on May 16, 2017. The entire disclosures of all of the above applications are incorporated herein by reference.

TECHNICAL FIELD

The present disclosure relates to a scroll compressor.

BACKGROUND

Previously, there is a scroll compressor that includes: a stationary scroll; a movable scroll that forms working chambers between the stationary scroll and the movable scroll; and a balancer that alleviates unbalance of a rotatable shaft caused by the movable scroll.

In this scroll compressor, when the movable scroll revolves relative to the stationary scroll, a refrigerant, which contains a lubricant oil, is suctioned into a corresponding one of the working chambers and is discharged from the working chamber after compression of the refrigerant in the working chamber.

SUMMARY

This section provides a general summary of the disclosure, and is not a comprehensive disclosure of its full scope or all of its features.

According to the present disclosure, there is provided a scroll compressor including:

a stationary scroll;

a movable scroll that forms a working chamber between the stationary scroll and the movable scroll, wherein:

the movable scroll is configured to revolve relative to the stationary scroll when the movable scroll is driven by a rotatable shaft; and when the movable scroll revolves, a volume of the working chamber progressively changes, so that a refrigerant is suctioned from a suction chamber into the working chamber and is discharged from the working chamber as a high pressure refrigerant after compression of the suctioned refrigerant in the working chamber;

a back pressure chamber forming portion that forms a back pressure chamber, wherein the back pressure chamber is configured to accumulate the high pressure refrigerant discharged from the working chamber and thereby generate a refrigerant pressure, which urges the movable scroll against the stationary scroll; and a balancer that is placed at an inside of the back pressure chamber, wherein the balancer is configured to be rotated by the rotatable shaft and alleviate weight unbalance generated at the rotatable shaft due to presence of the movable scroll at a time of revolving the movable scroll.

BRIEF DESCRIPTION OF DRAWINGS

The drawings described herein are for illustrative purposes only of selected embodiments and not all possible implementations, and are not intended to limit the scope of the present disclosure.

DETAILED DESCRIPTION

Figure 1:
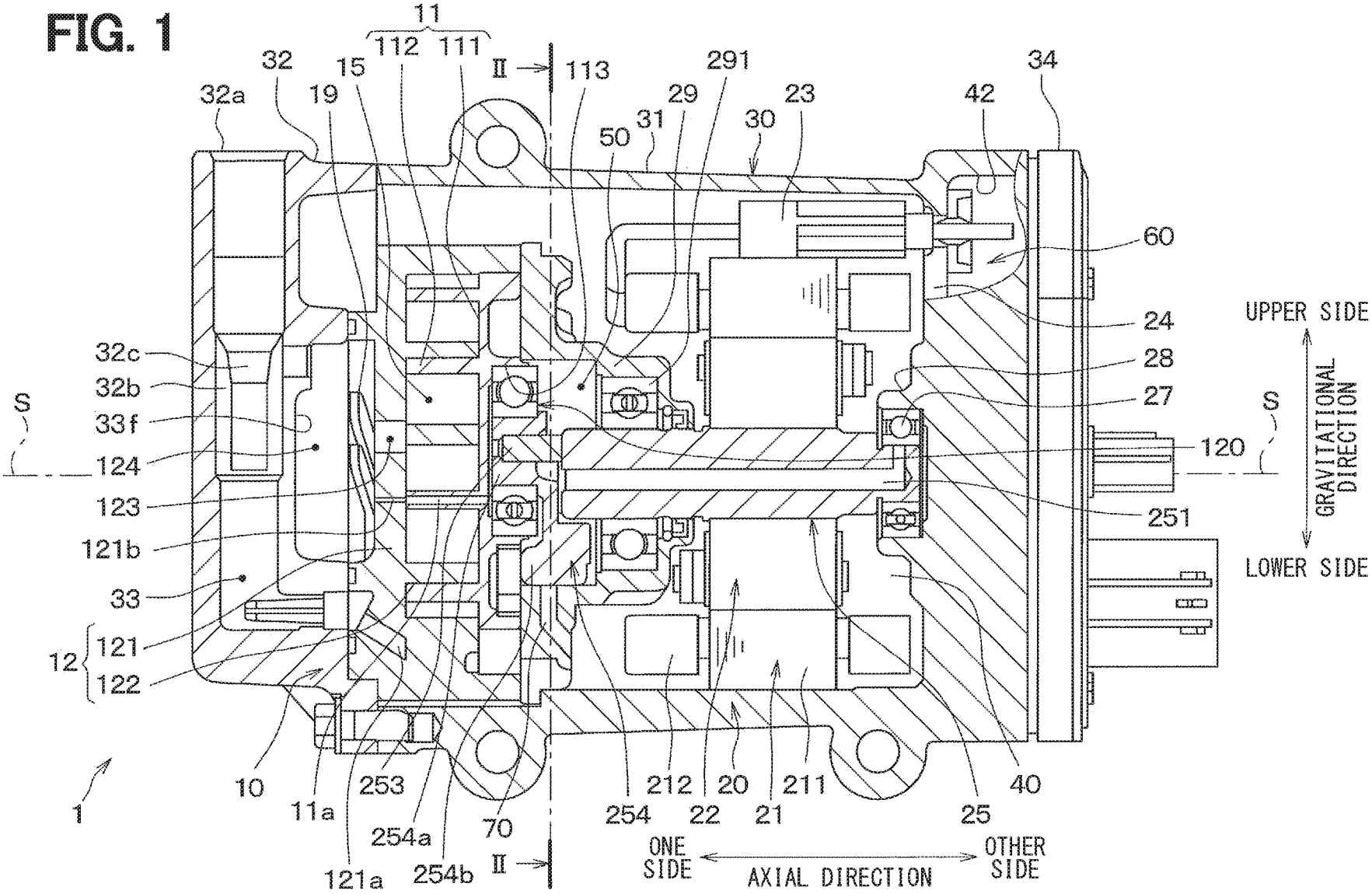
FIG. 1 is a diagram showing a structure of a cross section of a scroll compressor according to a first embodiment.

Previously, there is a scroll compressor that includes: a stationary scroll; a movable scroll that forms working chambers between the stationary scroll and the movable scroll; and a balancer that alleviates unbalance of a rotatable shaft caused by the movable scroll.

In this scroll compressor, when the movable scroll revolves relative to the stationary scroll, a refrigerant, which contains a lubricant oil, is suctioned into a corresponding one of the working chambers and is discharged from the working chamber after compression of the refrigerant in the working chamber.

Furthermore, the scroll compressor includes a bypass passage that conducts a portion of the discharged gas, which is discharged from the working chamber, to a back pressure chamber, which is formed on a back side of the movable scroll.

The discharged gas, which is conducted to the back pressure chamber, exerts a back pressure against the movable scroll, so that the movable scroll is urged against the stationary scroll. Thus, the movable scroll is brought into close contact with the stationary scroll, and thereby the gas tightness of the movable scroll relative to the stationary scroll is increased. In this way, the efficiency of the compression function can be increased.

The inventor of the present application has studied use of the scroll compressor that supplies a portion of the discharged refrigerant, which is discharged from a discharge hole, into the back pressure chamber, to apply the refrigerant pressure of the discharged refrigerant as a back pressure from the back pressure chamber to the movable scroll, to form a heat pump system that performs a heating operation. First of all, at the time of applying the scroll compressor to the heat pump system, which provides a required heating performance through use of a refrigeration cycle, an accumulator cycle is required to implement a cooling operation and the heating operation at the heat pump system under a low temperature environment that constitutes a required temperature range.

The required amount of refrigerant differs between the cooling operation and the heating operation, so that the accumulator is required to function as a liquid storage that stores the surplus refrigerant. Because of its simplicity, costs, and an installation layout, it is common to install the accumulator at an intake pipe that supplies the refrigerant to the compressor.

However, in a case where an operational state is taken into consideration, it is understood that a required time period, which is required to warm up the scroll compressor in a transition period for stabilizing the operational state after start of the heat pump system, is longer in the heating operation in comparison to the cooling operation. This is because of that an environmental temperature, an operational load, and a temperature/pressure of the refrigerant are relatively low at the time of executing the heating operation. However, since the environmental temperature, the operational load, and the temperature/pressure of the refrigerant are relatively low, the refrigerant state cannot be stabilized in the transition period. Therefore, particularly as a behavior of the liquid phase refrigerant, the liquid phase refrigerant, which is supposed to be stored in the accumulator in a stable state, is temporarily held at a location, such as a heat exchanger, the scroll compressor, a pipe or the like, which is other than the accumulator and has, for example, a low temperature or a large heat capacity during the stop period of the heat pump system.

Furthermore, this phenomenon also occurs in a case of using a refrigeration cycle, such as a receiver cycle, in which a receiver for storing the unnecessary refrigerant is placed between a condenser and a pressure reducing valve.

When the heat pump system starts its operation in the state where the liquid phase refrigerant is held at the location that is other than the accumulator or the receiver, the liquid phase refrigerant is suctioned into the scroll compressor at the time of moving the refrigerant to the accumulator or the receiver during a process of reaching the stable state. Thus, an unintended operational state (e.g., a state of compressing the liquid phase refrigerant) occurs at the scroll compressor, and thereby the vibration of the scroll compressor may possibly be increased.

According to one aspect of the present disclosure, a scroll compressor includes: a stationary scroll; and a movable scroll that forms a working chamber between the stationary scroll and the movable scroll. The movable scroll is configured to revolve relative to the stationary scroll when the movable scroll is driven by a rotatable shaft. In the scroll compressor, when the movable scroll revolves, a volume of the working chamber progressively changes, so that a refrigerant is suctioned from a suction chamber into the working chamber and is discharged from the working chamber as a high pressure refrigerant after compression of the suctioned refrigerant in the working chamber. The scroll compressor includes: a back pressure chamber forming portion that forms a back pressure chamber, wherein the back pressure chamber is configured to accumulate the high pressure refrigerant discharged from the working chamber and thereby generate a refrigerant pressure, which urges the movable scroll against the stationary scroll; and a balancer that is placed at an inside of the back pressure chamber, wherein the balancer is configured to be rotated by the rotatable shaft and alleviate weight unbalance generated at the rotatable shaft due to presence of the movable scroll at a time of revolving the movable scroll. The back pressure chamber forming portion has a discharge hole that is located on an outer side of the back pressure chamber in a radial direction of an axis of the rotatable shaft and communicates between the back pressure chamber and the suction chamber to discharge a liquid phase refrigerant from the back pressure chamber into the suction chamber.

Thereby, the liquid phase refrigerant is rotated along with the balancer in the back pressure chamber at the time of rotating the balancer in the back pressure chamber. At this time, the liquid phase refrigerant in the back pressure chamber can be discharged into the suction chamber through the discharge hole by a centrifugal force generated at the liquid phase refrigerant in the back pressure chamber. As a result, it is possible to limit the weight unbalance of the rotatable shaft, which would be generated by the rotation of the liquid phase refrigerant in the back pressure chamber along with the balancer at the time of rotating the balancer in the back pressure chamber. In this way, it is possible to limit the generation of the vibration of the rotatable shaft.

Thereby, it is possible to provide the scroll compressor that can limit the generation of the vibration.

Hereinafter, embodiments will be described with reference to the drawings. Among the embodiments, portions, which are identical to each other or equivalent to each other, are indicated by the same reference signs to simplify the description.

First Embodiment

Figure 2:
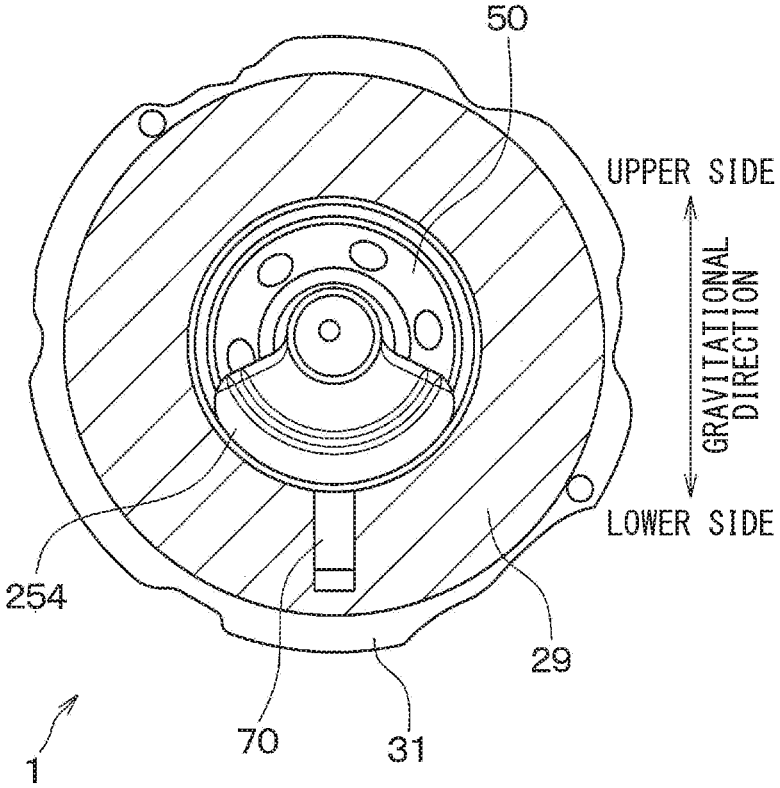
FIG. 2 is a cross-sectional view taken along line II-II in FIG. 1.

Hereinafter, a scroll compressor 1 of the first embodiment will be described with reference to FIGS. 1 and 2.

The scroll compressor 1 is applied to a refrigeration cycle device of a vehicle air conditioning apparatus. The refrigeration cycle device forms an accumulator cycle that includes an accumulator placed between a refrigerant inlet of the scroll compressor 1 and a refrigerant outlet of an evaporator. The accumulator is a gas liquid separator that separates the refrigerant outputted from the refrigerant outlet of the evaporator into a liquid phase refrigerant and a gas phase refrigerant, and the gas liquid separator accumulates the liquid phase refrigerant and conducts the gas phase refrigerant to the refrigerant inlet of the scroll compressor 1.

The scroll compressor 1 is an electric compressor and is of a horizontal type. The scroll compressor 1 includes a compressor mechanism unit 10, which compresses the refrigerant (fluid), and an electric motor unit 20, which drives the compressor mechanism unit 10, while the compressor mechanism unit 10 and the electric motor unit 20 are arranged one after another in a horizontal direction (transverse direction).

The compressor mechanism unit 10 and the electric motor unit 20 are received in a housing 30. The housing 30 includes: a tubular member 31, an axial direction of which is parallel with the horizontal direction; an oil separation vessel 32, which closes one axial side of the tubular member 31; and a cover member 34, which closes the other axial side of the tubular member 31, while the tubular member 31, the oil separation vessel 32 and the cover member 34 are joined together to form a closed container.

Specifically, the tubular member 31 is shaped in a cylindrical tubular form and is made of iron. The tubular member 31 forms: a suction chamber 40, which receives the compressor mechanism unit 10 and the electric motor unit 20; and a suction hole (not shown), which conducts the refrigerant received from the accumulator to the suction chamber 40. Furthermore, the tubular member 31 forms an inverter receiving portion 42 that receives an inverter 60, which supplies a three-phase AC power to the electric motor unit 20.

The cover member 34 is made of, for example, resin and closes an opening of the inverter receiving portion 42, which is located on the other axial side.

The oil separation vessel 32 is made of iron. The oil separation vessel 32 forms a refrigerant discharge outlet 32*a* and a lubricant oil separation chamber 32*b* while the lubricant oil separation chamber 32*b* is communicated with the refrigerant discharge outlet 32*a*. The lubricant oil separation chamber 32*b* receives a lubricant oil separation mechanism 32*c* that separates a lubricant oil from the high pressure refrigerant discharged from a discharge chamber described later, and the lubricant oil separation mechanism 32*c* conducts the high pressure refrigerant, from which the lubricant oil is separated, to the refrigerant discharge outlet 32*a*. An oil storage chamber 33 is formed at a lower side of the lubricant oil separation chamber 32*b* to accumulate the lubricant oil that is separated at the lubricant oil separation mechanism 32*c*. The tubular member 31 and the oil separation vessel 32 are gas-tightly joined together by, for example, bolts.

In a state where the scroll compressor 1 is installed to a vehicle, the axial direction of the tubular member 31 is parallel with the horizontal direction.

The electric motor unit 20 forms a three-phase AC synchronous motor and includes a stator 21, which is a stationary element, and a rotor 22, which is a rotatable element. The stator 21 is shaped in a generally cylindrical tubular form that extends in the horizontal direction as a whole, and the stator 21 is fixed to the tubular member 31 of the housing 30. Specifically, the stator 21 includes a stator core 211 and stator coils 212 while the stator coils 212 are wound around the stator core 211.

Supply of the three-phase AC power to the stator coils 212 is made from the inverter 60 through power supply terminals 23. The power supply terminals 23 are placed on the upper side of the stator 21 in the housing 30. Specifically, a power supply terminal fixation plate 24, through which the power supply terminals 23 extend, is placed on the other axial side of the electric motor unit 20 in the housing 30.

The rotor 22 includes permanent magnets and is placed on the radially inner side of the stator 21. The rotor 22 is shaped in a cylindrical tubular form, an axis of which coincides with the horizontal direction. A rotatable shaft 25, which extends in the horizontal direction, is fixed at a center hole of the rotor 22.

The rotatable shaft 25 is shaped in an elongated cylindrical tubular form and has an oil supply passage 251, which extends in the axial direction. An axial direction of the rotatable shaft 25 is an axial direction of the axis S and is the horizontal direction. The oil supply passage 251 opens to the back pressure chamber 50 at one axial side of the rotatable shaft 25. The oil supply passage 251 is an oil supply passage that supplies a lubricant oil to a bearing 27.

A portion of the rotatable shaft 25, which is located at the other side in the axial direction, is rotatably supported by the bearing 27. The bearing 27 is fixed to the tubular member 31 of the housing 30 through an intervening member 28.

A portion of the rotatable shaft 25, which is located on the one side of the rotor 22 in the axial direction, is rotatably supported by a bearing 291 that is provided at a front housing 29. The front housing 29 is shaped in a cylindrical tubular form that has an outer diameter and an inner diameter, both of which increase stepwise from the other side toward the one side in the axial direction. The front housing 29 is fixed in a state where an outermost peripheral surface of the front housing 29 contacts the tubular member 31 of the housing 30.

The portion of the rotatable shaft 25, which is located on the one side of the rotor 22 in the axial direction, is located at an inside of the front housing 29, and a portion of the front housing 29, which has a smallest inner diameter and is located at the other side in the axial direction, forms the bearing 291.

A back pressure chamber 50 is formed in the front housing (serving as a back pressure chamber forming portion) 29 at a location that is between a bearing 120 and the bearing 291. The back pressure chamber 50 is shaped in an annular form that is centered at the axis of the rotatable shaft 25. As described later, the back pressure chamber 50 accumulates a discharged refrigerant, which is discharged from the discharge chamber 124, and the back pressure chamber 50 applies a refrigerant pressure of the discharged refrigerant to a movable scroll 11 as a back pressure.

The one axial side of the rotatable shaft 25, an eccentric shaft 253 and a bush balancer 254 are received in the back pressure chamber 50. The eccentric shaft 253 is a shaft member that projects from the one axial side of the rotatable shaft 25 toward the one side in the axial direction. The eccentric shaft 253 is offset relative to the axis of the rotatable shaft 25 in a radial direction.

A discharge hole 70, which communicates between the back pressure chamber 50 and the suction chamber 40, is formed at the front housing 29. The discharge hole 70 is located on the lower side of the rotatable shaft 25 and the back pressure chamber 50 in the gravitational direction.

Specifically, the discharge hole 70 communicates with the back pressure chamber 50 at a location that is on an outer side of the back pressure chamber 50 in the radial direction and is on a lower side of the back pressure chamber 50 in the gravitational direction. The outer side in the radial direction is the outer side in the radial direction of the axis S of the rotatable shaft 25. Specifically, an inlet of the discharge hole 70 opens to the back pressure chamber 50 at the location that is on the outer side of the back pressure chamber 50 in the radial direction and on the lower side of the back pressure chamber 50 in the gravitational direction. An outlet of the discharge hole 70 is located on the outer side of the back pressure chamber 50 in the radial direction and on the lower side of the back pressure chamber 50 in the gravitational direction.

The eccentric shaft 253 is fitted into a boss portion 254*a* of the bush balancer 254. The bush balancer 254 includes a weight portion 254*b* that is located on an outer side of the boss portion 254*a* in the radial direction and is joined to the boss portion 254*a*. Specifically, the bush balancer 254 revolves together with the movable scroll 11 at the time of revolving the movable scroll 11 and thereby implements a function of alleviating the weight unbalance, which is generated at the rotatable shaft 25 due to presence of the movable scroll 11.

The movable scroll 11 is located on the one side of the front housing 29 in the axial direction and forms a movable member of the compressor mechanism unit 10. A stationary scroll 12, which forms a stationary member of the compressor mechanism unit 10, is located on the one side of the movable scroll 11 in the axial direction.

The movable scroll 11 and the stationary scroll 12 include a base plate 111 and a base plate 121 respectively, which are shaped in a circular disk form. The movable scroll 11 and the stationary scroll 12 are opposed to each other in the horizontal direction.

A support portion 113, which supports the bearing 120, is formed at a center of the base plate 111 of the movable scroll 11. The boss portion 254*a* of the bush balancer 254 is rotatably supported by the bearing 120.

A rotation limit mechanism (not shown) is provided to the movable scroll 11 and the front housing 29 to limit rotation of the movable scroll 11 about the eccentric shaft 253. Therefore, when the rotatable shaft 25 is rotated, the movable scroll 11 revolves (i.e., turns) about the axis S of the rotatable shaft 25, which serves as a center of the revolution, without rotating about the eccentric shaft 253. Specifically, the movable scroll 11 revolves relative to the stationary scroll 12.

The movable scroll 11 has a wrap 112, which is shaped in a spiral form and projects from the base plate 111 toward the stationary scroll 12. In contrast, the base plate 121 of the stationary scroll 12 is fixed to the tubular member 31 of the housing 30, and a wrap 122, which is shaped in a spiral form and is meshed with the wrap 112 of the movable scroll 11, is formed at an upper surface of the base plate 121 of the stationary scroll 12 (a surface of the base plate 121 of the stationary scroll 12 located on the movable scroll 11 side). Specifically, a groove portion, which is shaped in a spiral form, is formed at the upper surface of the base plate 121, and a side wall of the groove portion, which is shaped in the spiral form, forms the wrap 122 that is shaped in the spiral form.

The wrap 112 of the movable scroll 11 and the wrap 122 of the stationary scroll 12 are meshed with each other such that the wrap 112 of the movable scroll 11 and the wrap 122 of the stationary scroll 12 contact with each other at a plurality of locations, and thereby a plurality of working chambers 15, each of which is shaped in a crescent form, is formed between the wrap 112 of the movable scroll 11 and the wrap 122 of the stationary scroll 12. In FIG. 1, for the sake of simplicity, only one of the working chambers 15 is indicated by the reference sign, and the indication of the reference signs are omitted for the rest of the working chambers 15.

When the movable scroll 11 revolves, each working chamber 15 moves from the radially outer side toward the center while progressively changing a volume of the working chamber 15. The working chamber 15 is configured to receive the refrigerant, which flows from the accumulator through the suction chamber 40 and the suction hole, when the volume of the working chamber 15 is increased. The refrigerant in the working chamber 15 is compressed when the volume of the working chamber 15 is reduced.

A discharge port 123, into which the refrigerant compressed in the working chamber 15 is discharged, is formed at a center of the base plate 121 of the stationary scroll 12.

A discharge chamber 124, which communicates with the discharge port 123, is located on the one side of the base plate 121 of the stationary scroll 12 in the axial direction. The discharge chamber 124 is located on the other side of the lubricant oil separation chamber 32*b* in the axial direction while a partition wall 33*f* is interposed between the discharge chamber 124 and the lubricant oil separation chamber 32*b*. A passage 121*a*, which conducts the lubricant oil received from the oil storage chamber 33 to the back pressure chamber 50, is formed at the base plate 121 of the stationary scroll 12.

Furthermore, a back pressure intake port 121*b*, which guides the discharged refrigerant from the discharge chamber 124 to the back pressure chamber 50, is formed at the base plate 121 of the stationary scroll 12. A communication passage 11*a*, which communicates between the back pressure intake port 121*b* and the back pressure chamber 50, is formed at the movable scroll 11.

A reed valve (not shown) and a stopper 19 are installed at the discharge chamber 124. The reed valve prevents a backflow of the refrigerant to the working chamber 15 through the discharge port 123 and opens and closes the discharge port 123. The stopper 19 limits a maximum opening degree of the reed valve. The reed valve has a function of opening and closing the back pressure intake port 121*b*.

Figure 3:
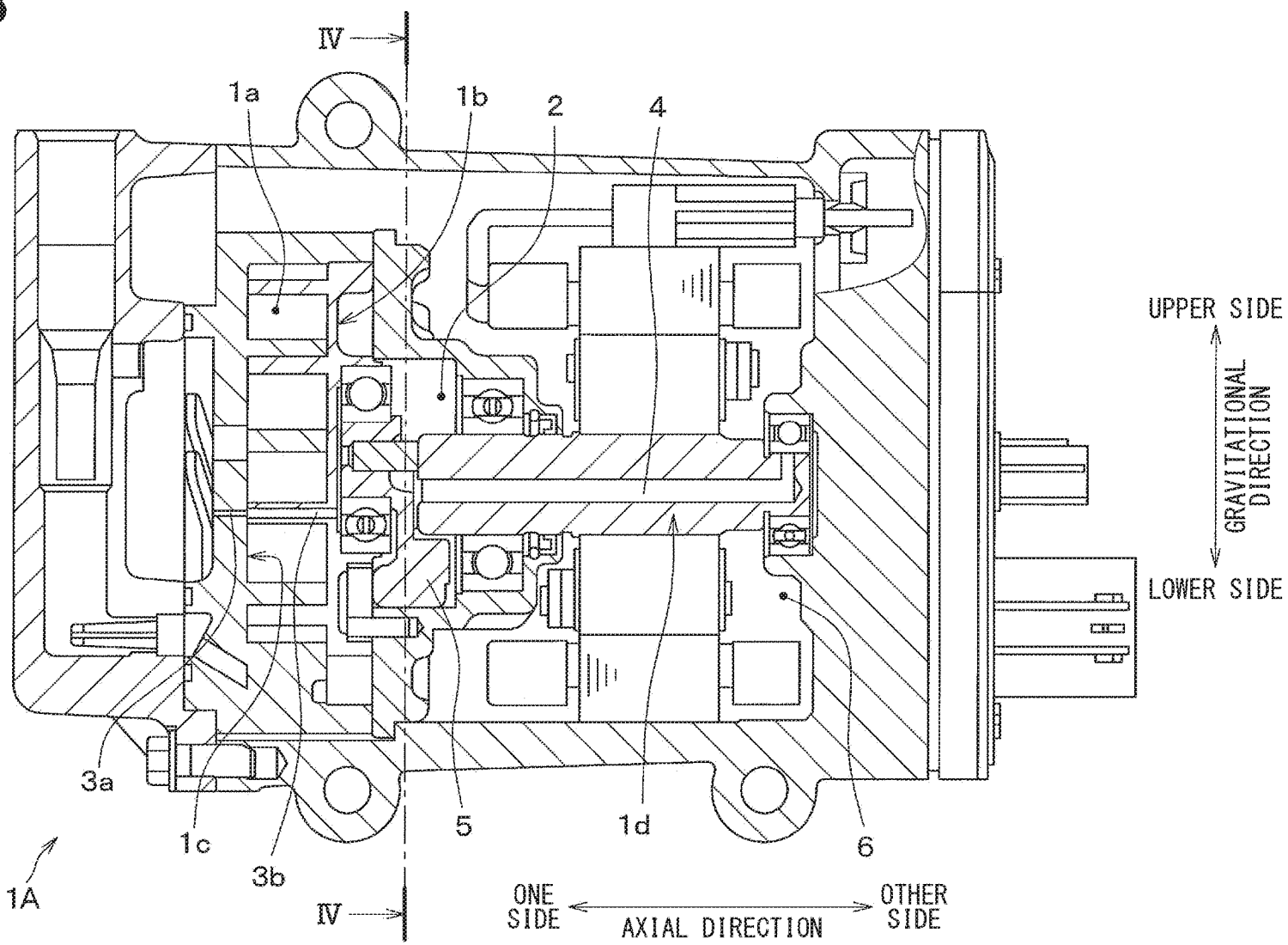
FIG. 3 is a diagram showing a cross section of a scroll compressor of a comparative example.
Figure 4:
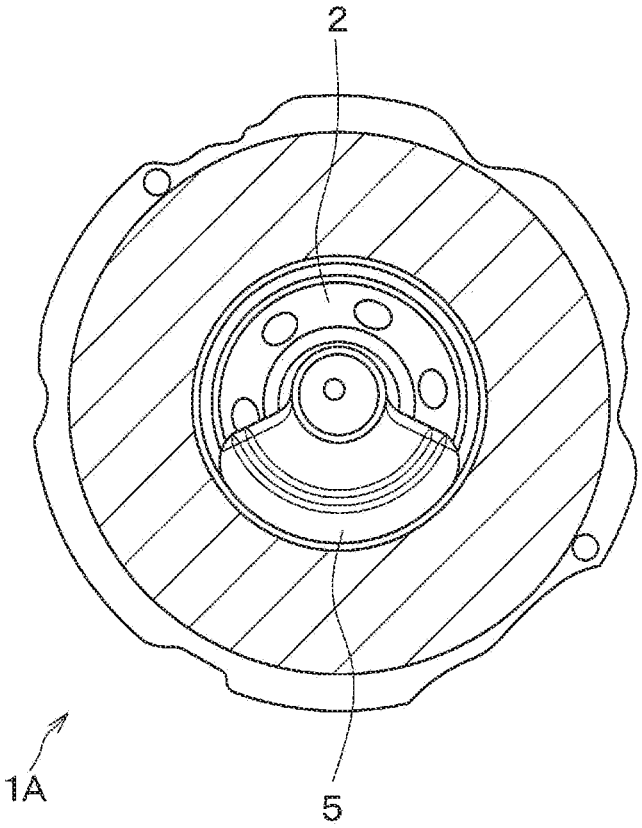
FIG. 4 RELATED ART
FIG. 4 is a cross-sectional view taken along line IV-IV in FIG. 3.

Next, prior to the description of the operation of the scroll compressor 1 of the present embodiment, a scroll compressor 1A of a comparative example, which does not have the discharge hole 70, will be described with reference to FIGS. 3 and 4.

In the scroll compressor 1A, the suctioned liquid phase refrigerant is suctioned into a working chamber 1*a* at a start initial period under the low temperature, and thereafter the liquid phase refrigerant is compressed and is discharged in the liquid phase state or the gas-liquid two-phase state.

A portion of the discharged refrigerant, which is discharged from the working chamber 1*a*, is guided to a back pressure chamber 2 through passages 3*a*, 3*b*, which are provided to ensure a required pressure of the discharged refrigerant, so that a required back pressure, which is the refrigerant pressure for urging the movable scroll 1*b* against a stationary scroll 1*c*, is ensured.

In order to limit an increase in the back pressure beyond the required pressure, a discharge passage 4, which discharges the refrigerant from the back pressure chamber 2 to a suction chamber 6, is provided, and a state of a weight balance is maintained by a differential pressure between the back pressure and the suction pressure and a flow passage resistance of the discharge passage 4.

However, in a case where the liquid phase refrigerant described above flows into the back pressure chamber 2, a balancer 5 is always rotated in the back pressure chamber 2 during the time of operating the scroll compressor 1A, and the liquid phase refrigerant is rotated along with the balancer 5 and is continuously circulated along the outer peripheral portion of the back pressure chamber 2 by the centrifugal force.

The discharge passage 4, which releases the back pressure to the suction chamber 6, is formed as an elongated hole that is formed in a rotatable shaft 1*d* for driving the movable scroll 1*b* and extends in the axial direction of the rotatable shaft 1*d*. Therefore, the liquid phase refrigerant in the back pressure chamber 2 is not guided to the discharge passage 4 formed at the rotatable shaft 1*d* while the balancer 5 is rotated in the back pressure chamber 2. Thus, when the temperature of the compressor main body and/or the pressure of the refrigerant are increased, the liquid phase refrigerant in the back pressure chamber 2 can be vaporized and discharged from the back pressure chamber 2.

Therefore, the liquid phase refrigerant is rotated along with the balancer 5 in the back pressure chamber 2 until the vaporization of the liquid phase refrigerant is completed. However, at this time, the viscous resistance, which is generated due to the weight fraction of the liquid phase refrigerant and the movement of the liquid phase refrigerant, causes a loss of the weight balance of the rotatable shaft 1*d*, and thereby the rotatable shaft 1*d* is placed in a state where weight unbalance is generated at the rotatable shaft 1*d*. As a result, the vibration of the rotatable shaft 1*d* may possibly be increased.

This disadvantage occurs not only in a case where the heating operation is performed under the low temperature environment but also possibly occurs in a case where a cooling operation is performed under the low temperature environment.

With respect to the above disadvantage, the scroll compressor 1 of the present embodiment is operated in the following manner to limit the weight unbalance of the rotatable shaft 25. Hereinafter, the operation of the scroll compressor 1 of the present embodiment will be described.

First of all, when the three-phase AC power is supplied from the inverter 60 to the stator coils 212, a rotating magnetic field is applied from the stator coils 212 to the rotor 22, and thereby a rotational force is generated at the rotor 22. Thus, the rotatable shaft 25 is rotated integrally with the rotor 22. At this time, in response to the rotation of the rotatable shaft 25, the bush balancer 254 is rotated in the back pressure chamber 50.

At this time, the rotational force of the rotatable shaft 25 is transmitted to the movable scroll 11 through the eccentric shaft 253. Therefore, the movable scroll 11 revolves relative to the stationary scroll 61. Thereby, the volumes of the working chambers 15 progressively change. Thus, the refrigerant, which is outputted from the accumulator, is suctioned into one of the working chambers 15 through a suction hole (not shown) and the suction chamber 40. Then, when the pressure of the refrigerant, which is suctioned into the working chamber 15, is increased, the pressure of the refrigerant opens the reed valve, and thereby the discharge port 123 is opened.

At this time, the high pressure refrigerant of the working chamber 15 is discharged into the discharge chamber 124 through the discharge port 123.

A majority of the refrigerant in the discharge chamber 124 flows into the lubricant oil separation chamber 32*b* through the refrigerant discharge outlet 32*a*. In the lubricant oil separation chamber 32*b*, the oil separation vessel 32 separates the lubricant oil from the refrigerant supplied from the discharge chamber 124, and the refrigerant, from which the lubricant oil is separated, flows from the refrigerant discharge outlet 32*a* into a refrigerant inlet of a condenser.

The lubricant oil, which is separated at the oil separation vessel 32, flows from the oil storage chamber 33 into the back pressure chamber 50 through the passage 121*a*. The lubricant oil from the back pressure chamber 50 is supplied to the bearings 120, 291. In addition, the lubricant oil in the back pressure chamber 50 is supplied to the bearing 27 through the oil supply passage 251 of the rotatable shaft 25.

In contrast, when the movable scroll 11 revolves relative to the stationary scroll 12, the back pressure intake port 121*b* and the communication passage 11*a* are intermittently communicated with each other. In the state where the reed valve opens the discharge port 123 due to the refrigerant pressure of the working chamber 15, the reed valve also opens the back pressure intake port 121*b*.

At this time, in the state where the back pressure intake port 121*b* and the communication passage 11*a* are communicated with each other, the high pressure refrigerant, which is discharged from the working chamber 15 into the discharge chamber 124 through the discharge port 123 and is other than the high pressure refrigerant supplied from the discharge chamber 124 to the lubricant oil separation chamber 32*b*, is supplied to the back pressure chamber 50 through the back pressure intake port 121*b* and the communication passage 11*a*. In response to this, the pressure of the refrigerant in the back pressure chamber 50 is applied to the movable scroll 11. Thus, the movable scroll 11 is urged against the stationary scroll 12.

In contrast, under the low temperature, when the three-phase AC power is supplied from the inverter 60 to the stator coils 212 to start the revolution of the movable scroll 11, the liquid phase refrigerant from the suction chamber 40 is suctioned into the corresponding one of the working chambers 15. The suctioned liquid phase refrigerant is compressed in the working chamber 15 and is discharged from the working chamber 15 into the discharge chamber 124 through the discharge port 123 as the liquid phase refrigerant (or the gas-liquid two-phase refrigerant).

Here, in the state where the reed valve opens the back pressure intake port 121*b*, and the back pressure intake port 121*b* and the communication passage 11*a* are intermittently communicated with each other, a portion of the liquid phase refrigerant and the lubricant oil discharged from the working chamber 15 into the discharge chamber 124 through the discharge port 123 flows into the back pressure chamber 50 through the back pressure intake port 121*b* and the communication passage 11*a*.

At this time, in response to the rotation of the rotatable shaft 25, the balancer 254 is rotated in the back pressure chamber 50. Thereby, the liquid phase refrigerant and the lubricant oil in the back pressure chamber 50 are gathered at the radially outer side of the balancer 254 by the centrifugal force.

In response to this, the liquid phase refrigerant and the lubricant oil are forced to flow from the back pressure chamber 50 into the suction chamber 40 through the discharge hole 70 by the centrifugal force and the gravity. Thus, it is possible to limit the continuous circulation of the liquid phase refrigerant at the radially outer side of the balancer 254 in response to the rotation of the balancer 254.

In the state where the reed valve closes the discharge port 123 due to a decrease in the refrigerant pressure of the working chamber 15, the reed valve also closes the back pressure intake port 121*b*.

According to the present embodiment described above, the scroll compressor 1 includes: the stationary scroll 12; and the movable scroll 11 that forms the working chambers 15 between the stationary scroll 12 and the movable scroll 11. The movable scroll 11 is configured to revolve relative to the stationary scroll 12 when the movable scroll 11 is driven by the rotatable shaft 25. When the movable scroll 11 revolves, the volume of each working chamber 15 progressively changes, so that the refrigerant is suctioned into the working chamber 15 and is discharged from the working chamber 15 as the high pressure refrigerant after compression of the suctioned refrigerant in the working chamber 15.

The scroll compressor 1 forms the back pressure chamber 50 that is configured to accumulate the high pressure refrigerant discharged from the working chamber 15 and thereby generate the refrigerant pressure, which urges the movable scroll 11 against the stationary scroll 12. The scroll compressor 1 includes the front housing 29 and the balancer 254 while the balancer 254 is placed at the inside of the back pressure chamber 50. The balancer 254 is configured to be rotated by the rotatable shaft 25 and alleviate the weight unbalance generated at the rotatable shaft 25 due to the presence of the movable scroll 11. The front housing 29 forms the discharge hole 70 that communicates between the back pressure chamber 50 and the suction chamber 40 to guide the liquid phase refrigerant and the lubricant oil from the back pressure chamber 50 into the suction chamber 40 when the liquid phase refrigerant and the lubricant oil flow from the working chamber 15 into the back pressure chamber 50 through the discharge chamber 124, the back pressure intake port 121*b* and the communication passage 11*a*.

Therefore, it is possible to urge the movable scroll 11 against the stationary scroll 12 by the refrigerant pressure of the liquid phase refrigerant (i.e., the back pressure) in the back pressure chamber 50, and it is possible to limit the rotation of the liquid phase refrigerant along with the balancer 254 at the time of rotating the balancer 254 in the back pressure chamber 50 along with the rotatable shaft 25.

Thus, in the scroll compressor 1 having a relatively low degree of design freedom, the interference of the counterweight effect of the balancer 254 is limited, and the generation of the vibration of the rotatable shaft 25 can be limited.

The counterweight effect of the balancer 254 is a function for alleviating the unbalance of the rotatable shaft 25.

In the present embodiment, the discharge hole 70 is located on the lower side of the back pressure chamber 50 in the gravitational direction and on the outer side of the back pressure chamber 50 in the radial direction. Therefore, the liquid phase refrigerant is discharged from the back pressure chamber 50 into the suction chamber 40 through the discharge hole 70 by using the centrifugal force, which is applied to the liquid phase refrigerant in response to the rotation of the balancer 254, and the gravity. Therefore, the liquid phase refrigerant can be effectively discharged into the suction chamber 40.

Second Embodiment

Figure 5:
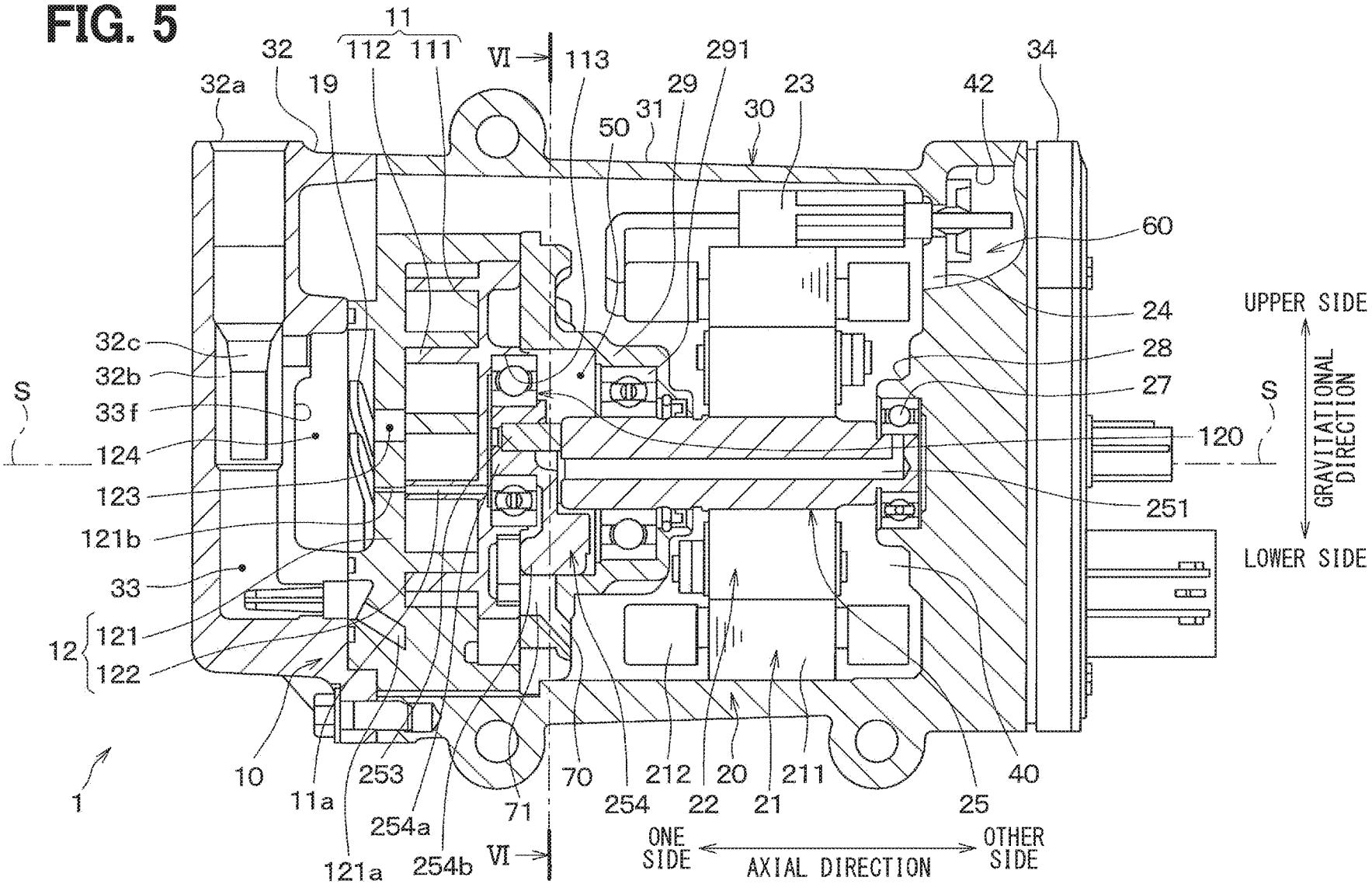
FIG. 5 is a diagram showing a structure of a cross section of a scroll compressor according to a second embodiment.
Figure 6:
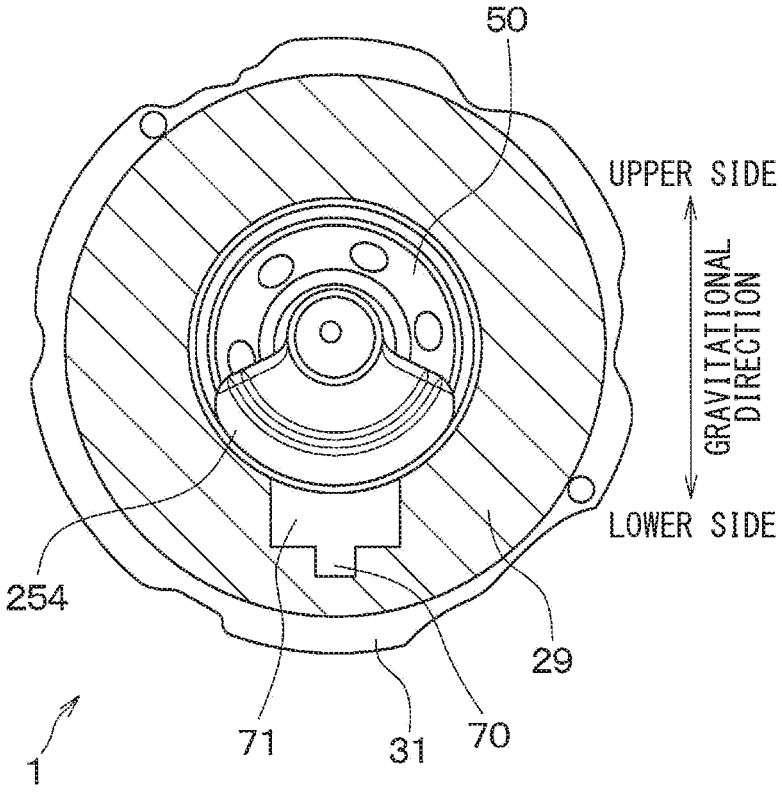
FIG. 6 is a cross-sectional view taken along line VI-VI in FIG. 5.

In a second embodiment, with reference to FIGS. 5 and 6, there will be described an example where the discharge hole 70 of the first embodiment is formed between a liquid storage chamber 71 and the suction chamber 40. In FIGS. 5 and 6, the reference signs, which are the same as those of FIGS. 1 and 2, indicate the same portions as those of FIGS. 1 and 2.

The present embodiment differs from the first embodiment with respect a modification of the location of the discharge hole 70 and addition of the liquid storage chamber 71. Besides these points, the other structure of the present embodiment is the same as that of the first embodiment. Therefore, there will be described about the modification of the location of the discharge hole 70 and the addition of the liquid storage chamber 71, and the other structure will not be described for the sake of simplicity.

The discharge hole 70 and the liquid storage chamber 71 of the present embodiment are located on the lower side of the back pressure chamber 50 in the gravitational direction and on the outer side of the back pressure chamber 50 in the radial direction.

The liquid storage chamber 71 is formed by a recess of the front housing 29, which is recessed away from the back pressure chamber 50 toward the radially outer side. Here, the radially outer side is an outer side in the radial direction of the axis S of the rotatable shaft 25.

The liquid storage chamber 71 of the present embodiment opens to the back pressure chamber 50 at a location that is on the outer side of the back pressure chamber 50 in the radial direction and on the lower side of the back pressure chamber 50 in the gravitational direction. In addition, the liquid storage chamber 71 opens toward the movable scroll 11. Thereby, the liquid storage chamber 71 is formed by the movable scroll 11 and the front housing 29.

The discharge hole 70 communicates between the liquid storage chamber 71 and the suction chamber 40. Specifically, the discharge hole 70 opens to the liquid storage chamber 71 at a location that is on the outer side of the liquid storage chamber 71 in the radial direction and on the lower side of the liquid storage chamber 71 in the gravitational direction.

The liquid storage chamber 71 of the present embodiment is wider than the discharge hole 70. For this reason, the liquid storage chamber 71 functions to temporarily store the liquid phase refrigerant and the lubricant oil, which are outputted from the back pressure chamber 50, and the discharge hole 70 functions to discharge the liquid phase refrigerant and the lubricant oil, which are outputted from the liquid storage chamber 71, to the suction chamber 40. A definition of the term "wider" will be described later.

According to the present embodiment described above, in the case where the inverter 60 supplies the three-phase AC power to the stator coils 212 to start the revolution of the movable scroll 11 at the low temperature, when the liquid phase refrigerant and the lubricant oil flow from the working chamber 15 into the back pressure chamber 50 through the discharge chamber 124, the back pressure intake port 121*b* and the communication passage 11*a*, the liquid phase refrigerant and the lubricant oil can be temporarily stored in the liquid storage chamber 71 until the evaporation of the liquid phase refrigerant through the warming up of the scroll compressor 1 is completed. In this way, the liquid phase refrigerant and the lubricant oil can be evacuated from the back pressure chamber 50 into the liquid storage chamber 71.

Accordingly, the liquid phase refrigerant and the lubricant oil from the liquid storage chamber 71 can be discharged into the suction chamber 40 through the discharge hole 70. Therefore, it is possible to further limit the continuous rotation of the liquid phase refrigerant along with the balancer 254 at the time of rotating the balancer 254 in the back pressure chamber 50.

Thus, like in the first embodiment, in the scroll compressor 1 having the relatively low degree of design freedom, the interference of the counterweight effect of the balancer 254 is limited, and the generation of the vibration of the rotatable shaft 25 can be limited.

Hereinafter, the definition of the term "wider", which is used for the purpose of comparing between the size of the liquid storage chamber 71 and the size of the discharge hole 70, will be described under an assumption of that imaginary spheres are respectively received in the liquid storage chamber 71 and the discharge hole 70 of the present embodiment.

First of all, the imaginary sphere, which is configured to be received in the liquid storage chamber 71 and has a largest possible radius in the liquid storage chamber 71, is defined as a first imaginary sphere, and the other imaginary sphere, which is configured to be received in the discharge hole 70 and has a largest possible radius in the discharge hole 70, is defined as a second imaginary sphere.

Here, when the radius of the first imaginary sphere, which is received in the liquid storage chamber 71, is larger than the radius of the second imaginary sphere, which is received in the discharge hole 70, it is defined that the liquid storage chamber 71 is wider than the discharge hole 70. In contrast, when the radius of the first imaginary sphere is smaller than the radius of the second imaginary sphere, it is defined that the liquid storage chamber 71 is narrower than the discharge hole 70.

Other Embodiments (1) In the first and second embodiments, there is described the example where the scroll compressor 1 is applied to the vehicle air conditioning apparatus. However, the present disclosure should not be limited to this example. For instance, the scroll compressor 1 may be applied to various air conditioning apparatuses, such as a building air conditioning apparatus, a home air conditioning apparatus.

(2) In the first and second embodiments, there is described the example where the electric compressor is used as the scroll compressor 1. However, the present disclosure should not be limited to this example. For instance, the scroll compressor 1 may be an engine-driven compressor that is driven by a drive force of an engine.

(3) In the first and second embodiments, there is described the example where the scroll compressor 1 is applied to the accumulator cycle. However, the present disclosure should not be limited to this example. For instance, the scroll compressor 1 may be applied to a receiver cycle, in which a receiver is placed between the condenser and the pressure reducing valve. The receiver is a gas liquid separator that separates the refrigerant, which is outputted from the condenser, into the gas phase refrigerant and the liquid phase refrigerant while the gas liquid separator supplies only the liquid phase refrigerant to the pressure reducing valve among the gas phase refrigerant and the liquid phase refrigerant.

Alternatively, the scroll compressor 1 may be applied to any of various refrigeration cycles that are other than the accumulator cycle and the receiver cycle and can switch its operation between the cooling operation and the heating operation.

(4) In the first and second embodiments, there is described the example where the inlet of the discharge hole 70 opens to the back pressure chamber 50 at the location that is on the lower side of the back pressure chamber 50 in the gravitational direction. However, the present disclosure should not be limited to this example. For instance, the inlet of the discharge hole 70 may open to the back pressure chamber 50 at a location that is other than the lower side of the back pressure chamber 50 in the gravitational direction (for example, the inlet of the discharge hole 70 may open to the back pressure chamber 50 at the location that is on the upper side of the back pressure chamber 50 in the gravitational direction) as long as the location of the inlet of the discharge hole 70 is on the outer side of the back pressure chamber 50 in the radial direction.

(5) In the first and second embodiments, there is described the example where the outlet of the discharge hole 70 is located on the lower side of the back pressure chamber 50 in the gravitational direction. However, the present disclosure should not be limited to this example. For instance, the outlet of the discharge hole 70 may be located at another location that is other than the location on the lower side of the back pressure chamber 50 in the gravitational direction.

(6) In the second embodiment, there is described the example where the liquid storage chamber 71 opens to the back pressure chamber 50 at the location that is on the lower side of the back pressure chamber 50 in the gravitational direction. However, the present disclosure should not be limited to this example. For instance, the liquid storage chamber 71 may open to the back pressure chamber 50 at a location that is other than the lower side of the back pressure chamber 50 in the gravitational direction as long as the location is on the outer side of the back pressure chamber 50 in the radial direction.

(7) In the second embodiment, there is described the example where the inlet of the discharge hole 70 opens to the liquid storage chamber 71 at the location that is on the outer side of the liquid storage chamber 71 in the radial direction and is on the lower side of the liquid storage chamber 71 in the gravitational direction. However, the present disclosure should not be limited to this example. For instance, the inlet of the discharge hole 70 may open to the liquid storage chamber 71 at a location that is other than the outer side of the liquid storage chamber 71 in the radial direction or a location that is other than the lower side of the liquid storage chamber 71 in the gravitational direction as long as the inlet of the discharge hole 70 opens to the liquid storage chamber 71.

(8) The present disclosure should not be limited to the above embodiments, and the above embodiments may be modified in various appropriate ways. The above embodiments are not necessarily unrelated to each other and can be combined in any appropriate combination unless such a combination is obviously impossible. The constituent component(s) of each of the above embodiments is/are not necessarily essential unless it is specifically stated that the constituent component(s) is/are essential in the above embodiment, or unless the component(s) is/are obviously essential in principle. In each of the embodiments described above, when a specific numerical value(s) such as a number, a numerical value, an amount or a range, of any of the constituent elements of the respective embodiments is mentioned, the present disclosure should not be limited to the specific numerical value(s) unless it is clearly stated that the specific numerical value(s) is essential, or the specific numerical value(s) is obviously essential in principle. In each of the embodiments described above, when a shape, a positional relationship or the like of the respective constituent elements is mentioned, it should not be limited to the shape, the positional relationship or the like of the respective constituent elements unless it is clearly stated that the shape, the positional relationship or the like of the respective constituent element(s) is essential, or the shape, the positional relationship or the like of the respective constituent element(s) is obviously essential in principle.

(Conclusion)

According to a first aspect recited in one or more or all of the embodiments described above, there is provided the scroll compressor including:

the stationary scroll;

the movable scroll that forms the working chamber between the stationary scroll and the movable scroll, wherein:

the movable scroll is configured to revolve relative to the stationary scroll when the movable scroll is driven by the rotatable shaft; and when the movable scroll revolves, the volume of the working chamber progressively changes, so that the refrigerant is suctioned from the suction chamber into the working chamber and is discharged from the working chamber as the high pressure refrigerant after compression of the suctioned refrigerant in the working chamber;

the back pressure chamber forming portion that forms the back pressure chamber, wherein the back pressure chamber is configured to accumulate the high pressure refrigerant discharged from the working chamber and thereby generate the refrigerant pressure, which urges the movable scroll against the stationary scroll; and the balancer that is placed at the inside of the back pressure chamber, wherein the balancer is configured to be rotated by the rotatable shaft and alleviate the weight unbalance generated at the rotatable shaft due to presence of the movable scroll at the time of revolving the movable scroll, wherein:

the back pressure chamber forming portion has the discharge hole that communicates between the radially outer side of the back pressure chamber, which is located radially outward in the radial direction of the axis of the rotatable shaft, and the suction chamber to discharge the liquid phase refrigerant from the back pressure chamber into the suction chamber when the liquid phase refrigerant flows from the working chamber into the back pressure chamber.

According to a second aspect, the discharge hole opens to the back pressure chamber at the location that is on the lower side of the back pressure chamber in the gravitational direction.

Thereby, the liquid phase refrigerant in the back pressure chamber can be discharged into the suction chamber through the discharge hole by the gravity and the centrifugal force.

According to a third aspect, the back pressure chamber forming portion has the liquid storage chamber that is located on the outer side of the back pressure chamber in the radial direction of the axis of the rotatable shaft and is communicated with the back pressure chamber to accumulate the liquid phase refrigerant discharged from the back pressure chamber; and the discharge hole communicates between the liquid storage chamber and the suction chamber to discharge the liquid phase refrigerant from the liquid storage chamber to the suction chamber.

Thereby, the liquid phase refrigerant is rotated along with the balancer at the time of rotating the balancer. At this time, the liquid phase refrigerant in the back pressure chamber can be accumulated in the liquid storage chamber by the centrifugal force generated at the liquid phase refrigerant in the back pressure chamber.

Therefore, the amount of the liquid phase refrigerant, which is rotated along with the balancer, can be reduced. In this way, the weight unbalance of the rotatable shaft, which is generated due to presence of the liquid phase refrigerant that is rotated along with the balancer, can be limited, and thereby the vibration of the rotatable shaft can be limited.

According to a fourth aspect, the discharge hole opens to the liquid storage chamber at the location that is on the lower side of the liquid storage chamber in the gravitational direction.

Thereby, the liquid phase refrigerant in the liquid storage chamber can be discharged into the suction chamber through the discharge hole by the gravity and the centrifugal force.

According to a fifth aspect, the rotatable shaft is arranged such that the axis of the rotatable shaft extends in the horizontal direction.

What is claimed is:

1. A scroll compressor comprising:

a stationary scroll;

a movable scroll that forms a working chamber between the stationary scroll and the movable scroll, wherein:

the movable scroll is configured to revolve relative to the stationary scroll when the movable scroll is driven by a rotatable shaft; and when the movable scroll revolves, a volume of the working chamber progressively changes, so that a refrigerant is suctioned from a suction chamber into the working chamber and is discharged from the working chamber as a high pressure refrigerant after compression of the suctioned refrigerant in the working chamber;

a back pressure chamber forming portion that forms a back pressure chamber, wherein the back pressure chamber is configured to accumulate the high pressure refrigerant discharged from the working chamber and thereby generate a refrigerant pressure, which urges the movable scroll against the stationary scroll; and a balancer that is placed at an inside of the back pressure chamber, wherein the balancer is configured to be rotated by the rotatable shaft and alleviate weight unbalance generated at the rotatable shaft due to presence of the movable scroll at a time of revolving the movable scroll, wherein:

the back pressure chamber forming portion has a discharge hole that communicates between a radially outer side of the back pressure chamber, which is located radially outward in a radial direction of an axis of the rotatable shaft, and the suction chamber to discharge a liquid phase refrigerant from the back pressure chamber into the suction chamber when the liquid phase refrigerant flows from the working chamber into the back pressure chamber;

the back pressure chamber forming portion has a liquid storage chamber that is located on an outer side of the back pressure chamber in the radial direction of the axis of the rotatable shaft and is communicated with the back pressure chamber to accumulate the liquid phase refrigerant discharged from the back pressure chamber; and the discharge hole communicates between the liquid storage chamber and the suction chamber to discharge the liquid phase refrigerant from the liquid storage chamber to the suction chamber.

2. The scroll compressor according to claim 1, wherein the discharge hole opens to the liquid storage chamber at a location that is on a lower side of the liquid storage chamber in a gravitational direction.

3. The scroll compressor according to claim 1, wherein the rotatable shaft is arranged such that the axis of the rotatable shaft extends in a horizontal direction.

* * * * *